US008514206B2

(12) United States Patent
Chou et al.

(10) Patent No.: US 8,514,206 B2
(45) Date of Patent: Aug. 20, 2013

(54) DISPLAY PROCESSING DEVICE AND TIMING CONTROLLER THEREOF

(75) Inventors: Yu-Pin Chou, Miao-Li Hsien (TW); Tzuo-Bo Lin, Taipei (TW); Ming-Syun Wu, Taipei Hsien (TW)

(73) Assignee: Realtek Semiconductor Corp., Hsinchu (TW)

( * ) Notice: Subject to any disclaimer, the term of this patent is extended or adjusted under 35 U.S.C. 154(b) by 1225 days.

(21) Appl. No.: 12/314,601

(22) Filed: Dec. 12, 2008

(65) Prior Publication Data

US 2009/0153545 A1 Jun. 18, 2009

(30) Foreign Application Priority Data

Dec. 14, 2007 (TW) ..... 96147977 A

(51) Int. Cl.
*G09G 5/00* (2006.01)

(52) U.S. Cl.
USPC ..... 345/204; 345/214; 345/3.1

(58) Field of Classification Search
USPC ..... 345/204–214, 87–99, 3.4, 3.1, 501, 345/519; 326/37–41; 348/469, 553–558; 710/8–14
See application file for complete search history.

(56) References Cited

U.S. PATENT DOCUMENTS

| | | | | |
|---|---|---|---|---|
| 7,123,248 | B1 * | 10/2006 | Lafleur | 345/204 |
| 7,372,298 | B2 * | 5/2008 | Chu et al. | 326/38 |
| 7,518,600 | B2 * | 4/2009 | Lee | 345/204 |
| 2005/0058233 | A1 * | 3/2005 | Nguyen et al. | 375/354 |
| 2006/0092152 | A1 * | 5/2006 | Jang et al. | 345/211 |
| 2007/0290904 | A1 * | 12/2007 | Kobayashi et al. | 341/126 |
| 2008/0068323 | A1 * | 3/2008 | Liao | 345/98 |
| 2008/0111919 | A1 * | 5/2008 | Hao et al. | 348/469 |
| 2008/0129665 | A1 * | 6/2008 | Huang et al. | 345/87 |
| 2008/0317440 | A1 * | 12/2008 | Shoji et al. | 386/124 |

* cited by examiner

*Primary Examiner* — Hong Zhou
(74) *Attorney, Agent, or Firm* — McClure, Qualey & Rodack, LLP

(57) ABSTRACT

A timing controller for a display processing device includes: a plurality of predetermined pins for receiving an image signal by a pin-share method, wherein the image signal is a first format image signal or a second format image signal; a detector coupled to the predetermined pins and for detecting at least one of the predetermined pins to determine whether the image signal is the first format image signal or the second format image signal and outputting a detection result; and a processor coupled to the detector and for processing the image signal according to the detection result to generate and output a timing control signal.

17 Claims, 4 Drawing Sheets

| Pin | LVDS format | DisplayPort format |
|---|---|---|
| 1 | L0P | M3P |
| 2 | L0N | M3N |
| 3 | L1P | |
| 4 | L1N | |
| 5 | L2P | |
| 6 | L2N | |
| 7 | L3P | |
| 8 | L3N | |
| 9 | L4P | |
| 10 | L4N | |
| 11 | L5P | M1P |
| 12 | L5N | M1N |
| 13 | L6P | |
| 14 | L6N | |
| 15 | L7P | M0P |
| 16 | L7N | M0N |
| 17 | L8P | A0P |
| 18 | L8N | A0N |
| 19 | L9P | M2P |
| 20 | L9N | M2N |
| 21 | SCL | |
| 22 | SDA | |
| 23 | | HD |

FIG. 2

DISPLAY PROCESSING DEVICE AND TIMING CONTROLLER THEREOF

CROSS-REFERENCE TO RELATED APPLICATION

This application claims priority of Taiwanese Application No. 096147977, filed on Dec. 14, 2007.

BACKGROUND OF THE INVENTION

1. Field of the Invention

The present invention relates to a display processing device, more particularly to a display processing device and a timing controller thereof that support a plurality of video interface standards using a simple configuration.

2. Description of the Related Art

There are many different types of video interface standards. This is particularly the case as analog systems are replaced with digital systems. Digital Visual Interface (DVI) and High-Definition Multimedia Interface (HDMI) are examples of digital video interface standards that have been developed to replace analog standards. Hence, some devices are designed with the ability to support a plurality of video interface standards so that video data from various different types of source devices may be displayed.

However, many control chips and connector pins are necessary in a device to allow the same to support a plurality of video interface standards, ultimately increasing cost, size, and design complexity of the device.

SUMMARY OF THE INVENTION

Therefore, the object of this invention is to provide a display processing device and a timing controller thereof that support a plurality of video interface standards using a configuration that does not require large numbers of control chips and connector pins.

According to one aspect, the display processing device for processing an image signal to display a processed image signal on a display device, the image signal is a first format image signal or a second format image signal, the display processing device comprises: a connector for receiving the image signal; a timing controller coupled to the connector and for generating a timing control signal according to the image signal received by the connector; and a driver coupled to the timing controller and for outputting the image signal on the display device according to the timing control signal; wherein when the image signal is the first format image signal, the timing controller receives the image signal through a plurality of predetermined pins; and when the image signal is the second format image signal, the timing controller receives the image signal through a portion of the predetermined pins.

According to another aspect, the timing controller of this invention comprises: a plurality of predetermined pins for receiving an image signal by a pin-share method, wherein the image signal is a first format image signal or a second format image signal; a detector coupled to the predetermined pins and for detecting at least one of the predetermined pins to determine whether the image signal is the first format image signal or the second format image signal and outputting a detection result; and a processor coupled to the detector and for processing the image signal according to the detection result to generate and output a timing control signal.

BRIEF DESCRIPTION OF THE DRAWINGS

Other features and advantages of the present invention will become apparent in the following detailed description of the preferred embodiments with reference to the accompanying drawings, of which:

FIG. 2 is a pin configuration table for pins of a timing controller according to an exemplary embodiment of the present invention;

DETAILED DESCRIPTION OF THE PREFERRED EMBODIMENTS

Figure 1:
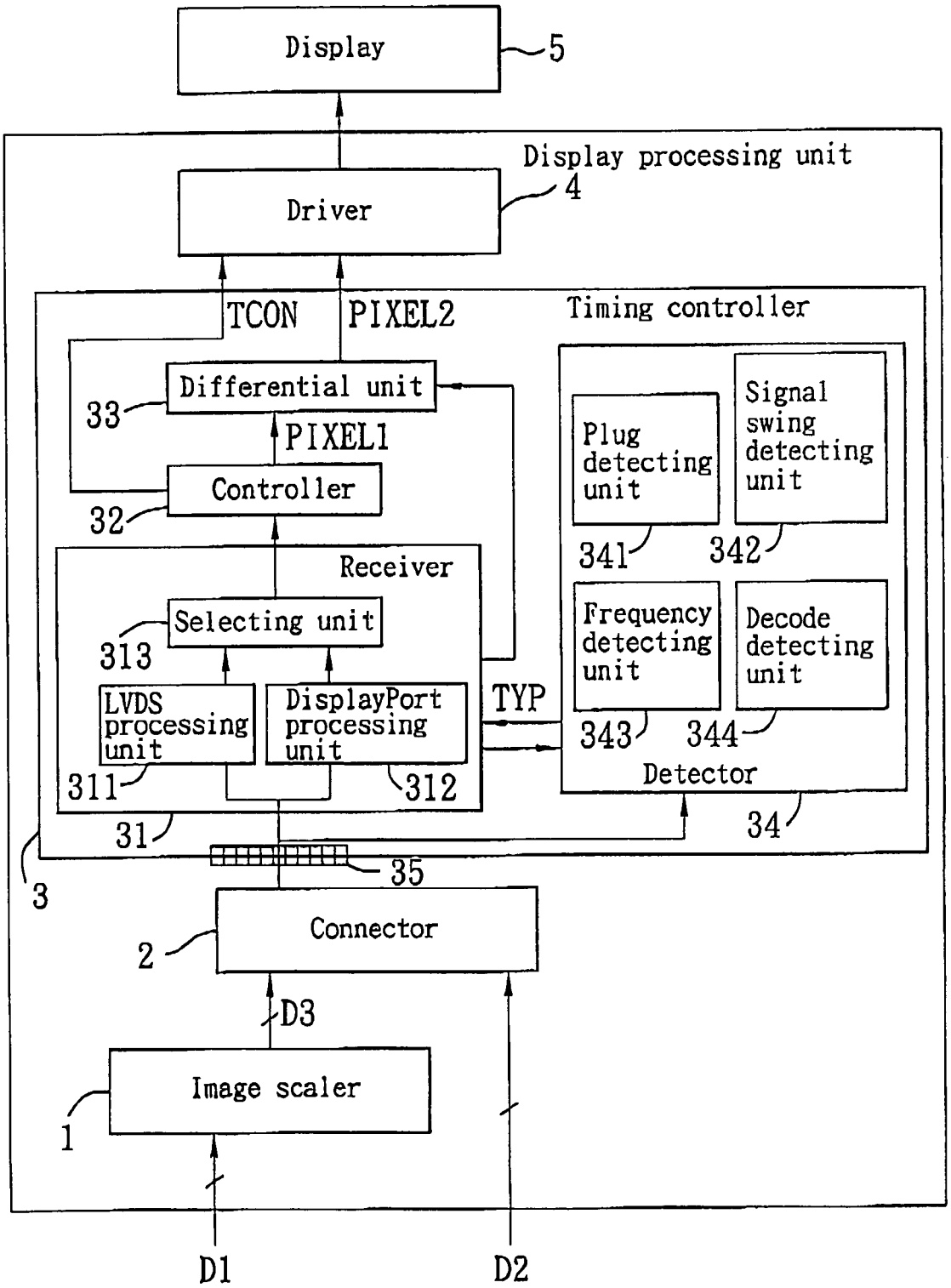
FIG. 1 is a schematic circuit block diagram of a display processing device according to a first preferred embodiment of the present invention.

Before the present invention is described in greater detail, it should be noted that like elements are denoted by the same reference numerals throughout the disclosure.

FIG. 1 is a schematic circuit block diagram of a display processing device according to a first preferred embodiment of the present invention. The display processing device is capable of receiving and processing an image signal (D1) in a first format and an image signal (D2) in a second format. In the first preferred embodiment, the image signal (D1) in the first format is an HDMI signal. However, the present invention is not limited in this respect and the image signal (D1) in the first format may be a VGA signal, a DVI signal, or a signal in another format corresponding to a different video interface standard. Further, in the first preferred embodiment, the image signal (D2) in the second format is a DisplayPort signal. A DisplayPort signal includes a Main Link (ML), an auxiliary channel (AUX channel), and a hot plug detect (HPD). The ML includes one/two/four differential pairs used to transmit an audio/video stream. The AUX channel includes one differential pair used to transmit state information and control instructions. Further, the HPD is a one-bit signal path, and is used to transmit a hot plug detect signal. Hence, in the first preferred embodiment, there are a total of 11 signal paths for the image signal (D2) in the second format.

As shown in FIG. 1, the display processing device of the first preferred embodiment includes an image scaler 1, a connector 2, a timing controller 3, and a driver 4.

The image scaler 1 receives the image signal (D1) in the first format, cooperates with a parameter setting of a setting channel (SC) to perform screen scaling of the image signal (D1) in the first format, improve image quality, perform color adjusting and other processing, and outputs an image signal (D3) in a low voltage differential signaling (LVDS) format. Hence, the image signal (D3) in the LVDS format is the image signal (D1) in the first format after undergoing processing as described above.

The image signal (D3) in the LVDS format may utilize an 8-bit or 10-bit standard. In the first preferred embodiment, an 8-bit standard is used. Therefore, the image signal (D3) in the LVDS format has eight data differential pairs and two time-pulse differential pairs, together with the setting channel (SC). Hence, there are a total of 22 signal paths for the image signal (D3) in the LVDS format.

The connector 2 receives the image signal (D3) in the LVDS format or the image signal (D2) in the DisplayPort format, and subsequently transmits the image signal to the timing controller 3. The timing controller 3 is coupled to the connector 2 to receive the image signal. The timing controller 3 generates a timing control signal TCON according to whether the image signal from the connector 2 is in the first format or the second format. The timing controller 3 includes a plurality of pins 35 that are shared to receive the image signal from the connector 2 (i.e., a pin-share scheme is utilized by the controller 3), a receiver 31 for receiving and processing the image signal from the pins 35, a controller 32 for outputting a pixel signal PIXEL1 and the timing control signal TCON in accordance with an output of the receiver 31, a differential unit 33 for converting the pixel signal PIXEL1 to generate and output a pixel signal PIXEL2 in a reduced swing differential signaling (RSDS) format, and a detector 34 for detecting whether the image signal received by the pins 35 from the connector 2 is in the first format or the second format and outputting a detecting signal (TYP) to the receiver 31. The detector 34 may be implemented through firmware or hardware.

In the following, the pin-share scheme utilized by the timing controller 3 will be described in greater detail. To provide an overview, when the image signal is the first format image signal, the timing controller 3 receives the image signal through predetermined pins 35. However, when the image signal is the second format image signal, the timing controller 3 receives the image signal through a portion of the pins 35.

FIG. 2 is a pin configuration table for the pins 35 of the timing controller 3, illustrating an exemplary embodiment of how the pins 35 of the timing controller 3 may be shared to receive LVDS format image signal and DisplayPort format image signal.

The ten differential pairs of the image signal in the LVDS format are respectively indicated as {L0P, L0N}, {L1P, L1N}, {L2P, L2N} . . . and {L9P, L9N}, and the time-pulse flow and data flow of the setting channel (SC) are respectively indicated as {SCL} and {SDA}. The four differential pairs of the main channel (ML) of the image signal in the DisplayPort format are respectively indicated as {M0P, M0N}, {M1P, M1N}, {M2P, M2N}, and {M3P, M3N}. The differential pair of the AUX channel is indicated as {A0P, A0N}, and the HPD is indicated as {HD}. As shown in FIG. 2, the {M0P, M0N} differential pair in the DisplayPort format and the {L7P, L7N} differential pair in the LVDS format share pin 15 and pin 16, the {M1P, M1N} differential pair in the DisplayPort format and the {L5P, L5N} differential pair in the LVDS format share pin 11 and pin 12, the {M2P, M2N} differential pair in the DisplayPort format and the {L9P, L9N} differential pair in the LVDS format share pin 19 and pin 20, the {M3P, M3N} differential pair in the DisplayPort format and the {L0P, L0N} differential pair in the LVDS format share pin 1 and pin 2, and the {A0P, A0N} differential pair in the DisplayPort format and the {L8P, L8N} differential pair in the LVDS format share pin 17 and pin 18. It is to be noted that in the first preferred embodiment, although the HPD {HD} does not have a pin that is shared with the LVDS format, the present invention is not limited in this respect and it is possible, in other embodiments, for the HPD {HD} to share a pin with the LVDS format.

Referring back to FIG. 1, after the image signal is input to the timing controller 3 from the connector 2 through the pins 35, the detector 34 determines whether the image signal received from the connector 2 is in the LVDS format or the DisplayPort format, and outputs the corresponding detection result (TYP) to the receiver 31.

The receiver 31 includes an LVDS processing unit 311, a DisplayPort processing unit 312, and a selecting unit 313. The LVDS processing unit 311 receives and processes the image signal from the pins 35, and obtains synchronization information and image data portions in accordance with the LVDS format so as to generate a first periodic signal and a first screen signal. The DisplayPort processing unit 312 receives and processes the image signal from the portion of pins 35, and obtains synchronization information and image data portions in accordance with the DisplayPort format so as to generate a second periodic signal and a second screen signal. The DisplayPort processing unit 312 also outputs a synchronization confirmation signal in accordance with the period of the second periodic signal, and generates a decode confirmation signal according to the second screen signal.

The selecting unit 313 determines which of either the signals generated by the LVDS processing unit 311 or the signals generated by the DisplayPort processing unit 312 to output in accordance with the detection result (TYP). When the detection result (TYP) indicates that the image signal received from the connector 2 is in the LVDS format, the selecting unit 313 selects the first periodic signal and the first screen signal to act respectively as a synchronization signal and a pixel signal. When the detection result (TYP) indicates that the image signal received from the connector 2 is in the DisplayPort format, the selecting unit 313 selects the second periodic signal and the second screen signal to act respectively as a synchronization signal and a pixel signal.

The controller 32 receives the synchronization signal and generates a timing control signal TCON to the driver 4.

The differential unit 33 converts the pixel signal PIXEL 1 to generate a pixel signal PIXEL2 in the RSDS format to the driver 4. The driver 4 is coupled to the timing controller 3 to receive the timing control signal TCON and the pixel signal PIXEL2, and drives a display 5 according to the timing control signal TCON and the pixel signal PIXEL2 in the RSDS format to display an image on the display 5.

The detector 34 of the timing controller 3 may be a plug detecting unit 341, a signal swing detecting unit 342, a frequency detecting unit 343, or a decode detecting unit 344. However, the present invention is not limited in this respect, and in some embodiments, any number or all of the detecting units 341, 342, 343, 344 may be used to simultaneously perform detection so as to enhance detection accuracy. In the following, the operation of each of the detecting units 341, 342, 343, 344 will be described.

The plug detecting unit 341 detects a voltage value from one or more pins among the pins 35 of the timing controller 3 to determine whether the image signal received from the connector 2 is the first format image signal or the second format image signal. In particular, the plug detecting unit 341 detects a signal level (i.e., a voltage value) of the pin for the HPD (HD) so as to determine whether the image signal received from the connector 2 is the DisplayPort format image signal or the LVDS format image signal. As an example, with reference to FIG. 2, the plug detecting unit 341 detects the signal level of the pin 23, and if it is at a high potential, it is determined that the image signal received from the connector 2 is the DisplayPort format image signal. On the other hand, if the signal level of the pin 23 is at a low potential, the plug detecting unit 341 determines that the image signal received from the connector 2 is the LVDS format image signal.

The signal swing detecting unit 342 detects the signal swing from one or more unshared pins among the pins 35 to determine whether the image signal received from the connector 2 is the DisplayPort format image signal or the LVDS format image signal. As an example, with reference to FIG. 2, the signal swing detecting unit 342 detects whether there is the predetermined signal swing at pin 3. If the predetermined signal swing is not present at pin 3 (e.g., if there is no signal swing at pin 3), the signal swing detecting unit 342 determines that the image signal received from the connector 2 is the DisplayPort format image signal, while if the predetermined signal swing is present at pin 3, the signal swing detecting unit 342 determines that the image signal received from the connector 2 is the LVDS format.

The frequency detecting unit 343 detects a signal frequency from one or more pins among the pins 35 of the timing controller 3 to determine whether the image signal received from the connector 2 is the first format image signal or the second format image signal. In particular, the frequency detecting unit 343 detects a signal frequency of a time-pulse differential pair {SCL} (pin 21 in FIG. 2). If a frequency signal is detected, it is determined that the image signal received from the connector 2 is the LVDS format image signal, while if no frequency signal is detected, it is determined that the image signal is the DisplayPort format image signal. In some embodiments, the frequency detecting unit 343 detects the input signal of the pin of the AUX channel, so as to determine whether the frequency of the input signal exceeds a threshold value of, for example, 1 MHz, to determine whether the image signal received from the connector 2 is the LVDS format image signal or the DisplayPort format image signal.

The decode detecting unit 344 detects a synchronization confirmation signal and a decode confirmation signal of the DisplayPort processing unit 312. If the confirmation signals indicate a normal state, it is determined that the image signal received from the connector 2 is the DisplayPort format image signal, while if the confirmation signals indicate a state that is abnormal or the generation of a random code, it is determined that the image signal received from the connector 2 is the LVDS format image signal.

Figure 3:
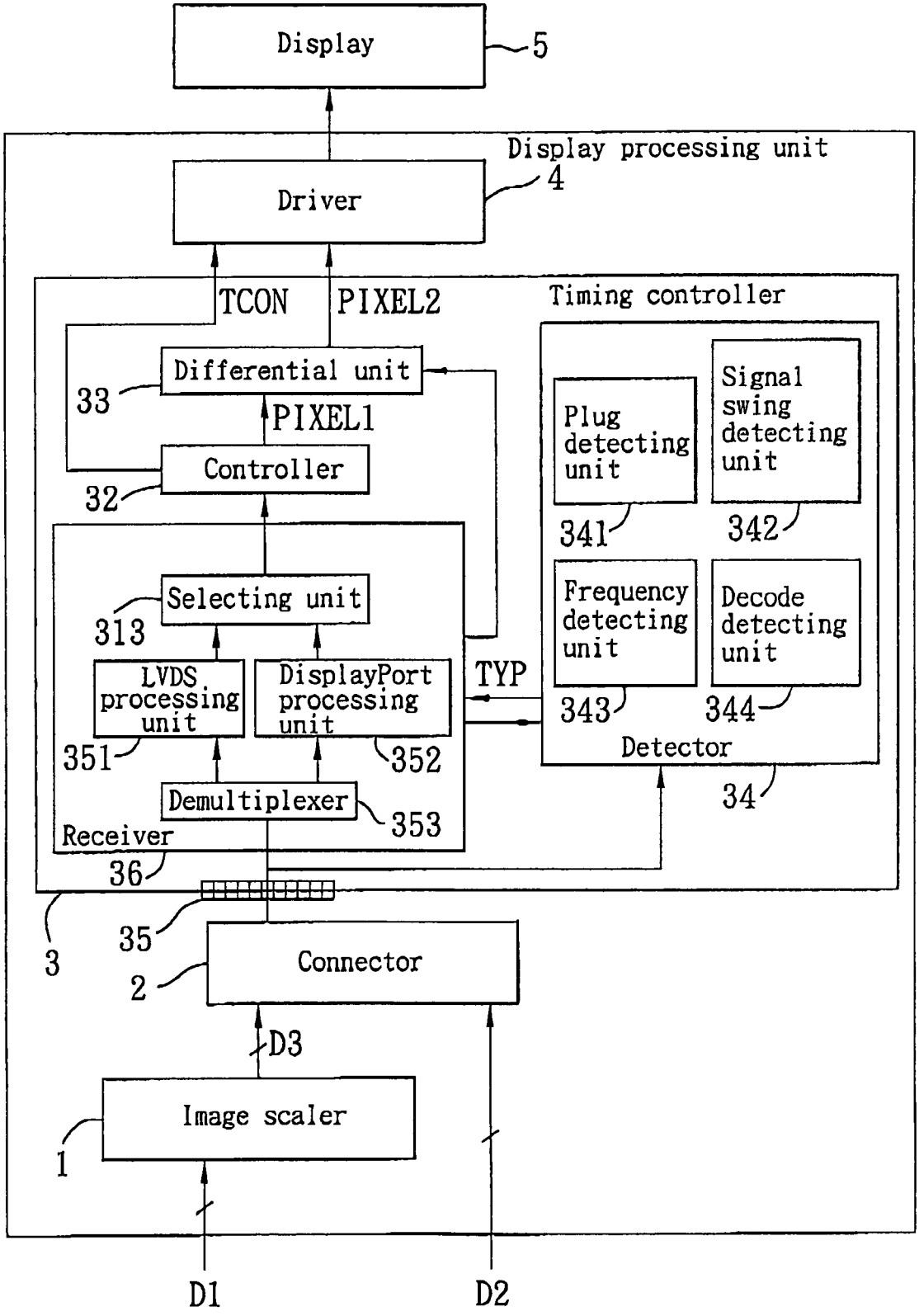
FIG. 3 is a schematic circuit block diagram of a display processing device according to a second preferred embodiment of the present invention.

Referring to FIG. 3, a display processing device according to a second preferred embodiment of the present invention will now be described. The display processing device of the second preferred embodiment is different from the display processing device of the first preferred embodiment in that the receiver 36 of the timing controller 3 further includes a demultiplexer 353.

The demultiplexer 353 determines whether to transmit the image signal received from the connector 2 to the LVDS processing unit 351 or the DisplayPort processing unit 352 according to the detection result (TYP). When the detection result (TYP) indicates that the image signal received from the connector 2 is the LVDS format image signal, the demultiplexer 353 transmits the image signal to the LVDS processing unit 351 for signal processing. However, when the detection result (TYP) indicates that the image signal received from the connector 2 is the DisplayPort format image signal, the demultiplexer 353 transmits the image signal to the DisplayPort processing unit 352 for signal processing.

Due to the fact that the demultiplexer 353 can categorize the image signal, signal interference between the LVDS processing unit 351 and the DisplayPort processing unit 352 may be reduced. In other words, if the image signal is the LVDS format image signal, the DisplayPort processing unit 352 will not receive the image signal. Therefore, the DisplayPort processing unit 352 will not perform any operation so that power consumption is reduced. Similarly, if the image signal is the DisplayPort format image signal, the LVDS processing unit 351 will not receive the image signal. Therefore, the LVDS processing unit 351 will not perform any operation so that power consumption is reduced.

Other aspects of the second preferred embodiment are identical to the first preferred embodiment, and therefore omitted here for the sake of brevity.

Figure 4:
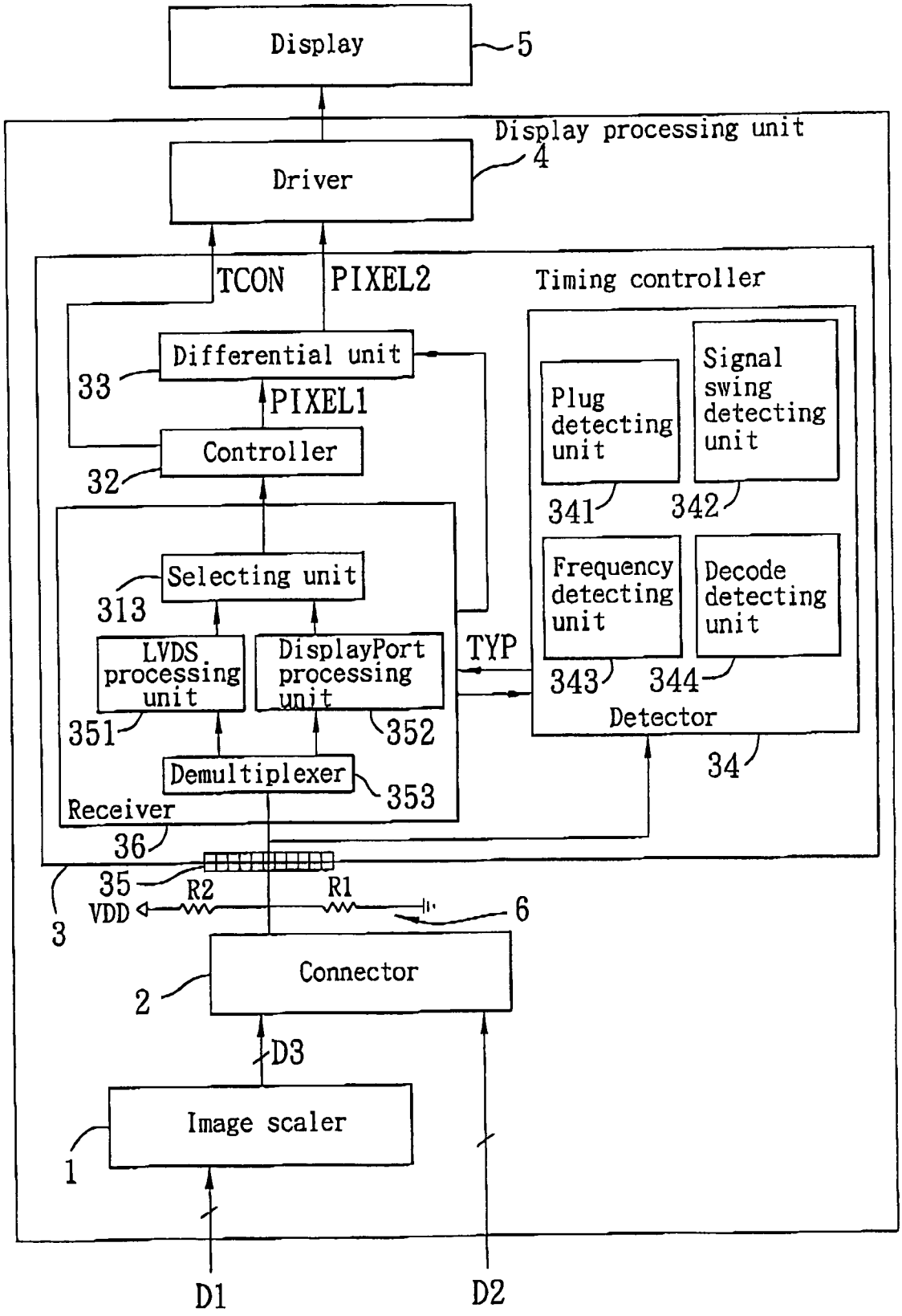
FIG. 4 is a schematic circuit block diagram of a display processing device according to a third preferred embodiment of the present invention.

Referring to FIG. 4, a display processing device according to a third preferred embodiment of the present invention is different from the display processing device of the second preferred embodiment in that the display processing device further includes a resistor unit 6 disposed between the timing controller 3 and the connector 2 to reduce interference among signals and stabilize potential levels. In one embodiment, the resistor unit 6 is disposed between the pin of the HPD {HD} of the timing controller 3 and the pin of the connector 2, including a 4.7K ohm pull-high resistor R2 and a 100K ohm pull-low resistor R1. It is to be noted that although the resistor unit 6 of this embodiment is disposed outside the timing controller 3, the present invention is not limited in this regard and the resistor unit 6 may be disposed within the timing controller 3. Other aspects of the third preferred embodiment are identical to the first and second preferred embodiments, and therefore omitted here for the sake of brevity.

It is to be noted that connector 2 in this invention is an alternative device. The image scaler 1 may directly output the image signal (D3) to the timing controller 3 and the image signal (D2) may be directly inputted into timing controller 3. This invention is not limited to the aforementioned embodiments.

In conclusion, the display processing device of the present invention supports image signals that are in the LVDS format and DisplayPort format without requiring the use of a large number of control chips, and further utilizes a pin-sharing scheme to thereby reduce the total number of pins needed to receive the image signals. Therefore, the cost, area, and design complexity of the display processing device of the present invention are reduced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A display processing device, adapted for processing an image signal to display a processed image signal on a display device, the image signal being a first format image signal or a second format image signal, comprising:

a connector for receiving the image signal;

a timing controller coupled to the connector and for generating a timing control signal according to the image signal received by the connector; and a driver coupled to the timing controller and for outputting the image signal on the display device according to the timing control signal;

wherein when the image signal is the first format image signal, the timing controller receives the image signal through a plurality of predetermined pins; and when the image signal is the second format image signal, the timing controller receives the image signal through a portion of the predetermined pins;

wherein the timing controller comprises:

a detector for detecting whether the image signal is the first format image signal or the second format image signal, and the detector detects a signal from at least one pin among the predetermined pins of the timing controller to determine whether the image signal is the first format image signal or the second format image signal.

2. The display processing device of claim 1, wherein the timing controller comprises:

a first processing unit coupled to the predetermined pins and for processing the first format image signal; and a second processing unit coupled to the portion of the predetermined pins and for processing the second format image signal.

3. The display processing device of claim 1, wherein the detector detects a voltage value of the signal from at least one pin among the predetermined pins of the timing controller to determine whether the image signal is the first format image signal or the second format image signal.

4. The display processing device of claim 1, wherein the detector detects a signal frequency of the signal from at least one pin among the predetermined pins of the timing controller to determine whether the image signal is the first format image signal or the second format image signal.

5. The display processing device of claim 1, wherein the detector detects a signal swing of the signal from at least one pin among the predetermined pins to determine whether the image signal is the first format image signal or the second format image signal; and the pin being detected is a non-shared pin of the predetermined pins.

6. The display processing device of claim 1, wherein the detector is implemented by firmware.

7. The display processing device of claim 1, wherein the first format image signal is a low voltage differential signaling (LVDS) format image signal and the second format image signal is a DisplayPort format image signal.

8. The display processing device of claim 7, wherein the predetermined pins include at least ten pairs of pins for receiving the LVDS format image signal, and the portion of the predetermined pins includes five pairs of pins from the at least ten pairs of pins for receiving the DisplayPort format image signal.

9. A timing controller comprising:

a plurality of predetermined pins for receiving an image signal by pin-share method, wherein the image signal is a first format image signal or a second format image signal;

a detector coupled to the predetermined pins and for detecting at least one of the predetermined pins to determine whether the image signal is the first format image signal or the second format image signal and outputting a detection result; and a processor coupled to the detector and for processing the image signal according to the detection result to generate and output a timing control signal;

wherein the detector detects a signal from at least one of the predetermined pins to determine whether the image signal is the first format image signal or the second format image signal.

10. The timing controller of claim 9, wherein when the image signal is the first format image signal, the timing controller receives the image signal through the predetermined pins; and when the image signal is the second format image signal, the timing controller receives the image signal through a portion of the predetermined pins.

11. The timing controller of claim 10, wherein the processor includes:

a first processing unit coupled to the predetermined pins and for processing the image signal when the image signal is the first format image signal; and a second processing unit coupled to the portion of the predetermined pins and for processing the image signal when the image signal is the second format image signal.

12. The timing controller of claim 9, wherein the detector detects a voltage value of the signal from at least one of the predetermined pins to determine whether the image signal is the first format image signal or the second format image signal.

13. The timing controller of claim 9, wherein the detector detects a signal frequency of the signal from at least one of the predetermined pins to determine whether the image signal is the first format image signal or the second format image signal.

14. The timing controller of claim 9, wherein the detector detects a signal swing of the signal from at least one of the predetermined pins to determine whether the image signal is the first format image signal or the second format image signal.

15. The timing controller of claim 9, wherein the detector is implemented by firmware.

16. The timing controller of claim 9, wherein the first format image signal is a low voltage differential signaling (LVDS) format image signal and the second format image signal is a DisplayPort format image signal.

17. The timing controller of claim 16, wherein the predetermined pins include at least ten pairs of pins for receiving the image signal with the LVDS format, and five pairs of pins from among the at least ten pairs of pins for receiving the image signal with the DisplayPort format.

* * * * *